United States Patent [19]

Nakamura et al.

[11] 3,940,920

[45] Mar. 2, 1976

[54] ZONE TIME DISPLAY CLOCK

[75] Inventors: Shoichi Nakamura, Tondabayashi; Toshiaki Inui, Nara; Yoshio Horiike, Neyagawa, all of Japan

[73] Assignee: Matsushita Electric Industrial Co., Ltd., Kadoma, Japan

[22] Filed: Nov. 14, 1974

[21] Appl. No.: 523,848

Related U.S. Application Data

[63] Continuation of Ser. No. 342,621, March 19, 1973.

[52] U.S. Cl. ..... 58/42.5; 58/4 A; 58/50 R

[51] Int. Cl.[2] ..... G04B 19/22

[58] Field of Search ..... 58/4 R, 4 A, 42.5, 44, 58/43, 50 R, 23 R

[56] References Cited

UNITED STATES PATENTS

| | | | |
|---|---|---|---|
| 3,186,158 | 6/1975 | Miller | 58/42.5 |
| 3,653,204 | 4/1972 | Miwa | 58/4 A |

*Primary Examiner*—George H. Miller, Jr.
*Assistant Examiner*—U. Weldon
*Attorney, Agent, or Firm*—Stevens, Davis, Miller & Mosher

[57] ABSTRACT

A zone time display clock having a zone or locality appointing and displaying means having a form of a world map and provided with touch detecting terminals disposed on the world map and with zone illuminating means for illuminating the designated zone. The clock further comprises a reference clock, a time difference generating circuit for generating the time difference signals for the designated and the "home" localities with respect to the reference locality alternately, touch switch means for memorizing a touched place in the world map and activating the zone displaying means and the time difference generating circuit, time and date difference calculating means for calculating the time and the date difference for the designated locality with respect to the "home" locality, and display driving means for displaying the time and the date difference or the date for the designated locality.

9 Claims, 4 Drawing Figures

FIG. 2

| | | D | $P_2$ | | $P_1$ | $A_5$ | $A_5'$ |
|---|---|---|---|---|---|---|---|
| 1° | $X + Y < 12$ | 0 | 0 | $X + Y = x + y$ | 0 | 0 | 0 |
| 2° | $24 > X + Y \geqq 12$ | 0 | 1 | $X+Y-12 = X+Y-12 = x+y-12$ | 0 | 0 | 1 |
| | | | | $X+Y-12 = (X-12)+Y = x+y$ | 1 | 0 | 0 |
| | | | | $X+Y-12 = X+(Y-12) = x+y$ | 0 | 1 | 0 |
| 3° | $36 > X + Y \geqq 24$ | 1 | 0 | $X+Y-24 = (X-12)+Y-12 = x+y-12$ | 1 | 0 | 1 |
| | | | | $X+Y-24 = X+(Y-12)-12 = x+y-12$ | 0 | 1 | 1 |
| | | | | $X+Y-24 = (X-12)+(Y-12) = x+y$ | 1 | 1 | 0 |
| 4° | $48 > X+Y \geqq 36$ | 1 | 1 | $X+Y-36 = (X-12)+(Y-12) = x+y-12$ | 1 | 1 | 1 |

$$P_2 = P_1 \oplus A_5 \oplus A_5'$$
$$D = P_1(A_5 + A_5') + A_5 A_5' = P_1 \overline{P_2} + A_5 A_5'$$

| Y \ X | X1' | X2' | X3' | X4' | X5' | X6' |
|---|---|---|---|---|---|---|
| Y1' | 0 | 2 | 4 | 6 | 8 | 10 |
| Y2' | 1 | 3 | 5 | 7 | 9 | 11 |
| Y3' | 12 | 14 | 16 | 18 | 20 | 22 |
| Y4' | 13 | 15 | 17 | 19 | 21 | 23 |

ZONE TIME DISPLAY CLOCK

This is a continuation, of application Ser. No. 342,621, filed Mar. 19, 1973.

This invention relates to a zone time display clock capable of selectively indicating the time of one of various times zones or localities in the world in a same time indicator in the designation by a user.

A zone time display clock is a timepiece which can indicate the time of a selected zone in a same time indicator immediately after the zone is appointed. Several zone time display clocks have been proposed such as U.S. Pat. No. 3,186,158 granted to M.E. Miller, "Computron" of Bulova Watch Co., and "World Clock" of Data Time Inc. The zone time display clock proposed by Miller is an electric clock in which, when a user consults the city or zone lists and appoints the predetermined number for the desired zone on a dial switch, turns on the indication lamp of the name of the designated city or zone and time thereof to display the zone name and the time selectively. This zone time display clock is inconvenient in the point that one must consult a list to find out the number of the desired zone and set the number in the dial switch. Further, since a multiplicity of lamps are arranged in three groups in the time indication panel (24 lamps for clock hour indication, 60 lamps for each of minute and second indications) and selectively connected to a power source through a rotary stepping switch to indicate the clock hour, minutes and seconds at the three lamp positions, it is not very convenient to read out the time. Further, various problems may arise from the mechanical rotary portions from the point of view of noise, service life, etc.

Nixie tubes (trade mark) are used in said "Computron" and "World Clock" to facilitate the reading thereof "Computron" is a zone time display clock formed of electronic circuits in which designation of a desired zone can be done by pushing one of twenty-four piano switches corresponding to the respective time zones in the world. The designated zone, however, is not apparently displayed and therefore one cannot know from the display the time of what zone is displayed. Further, in case of using this timepiece in New York, for example, when one wishes to know the London time and then reset the timepiece into the New York time indication, one should first search for and push the London time switch and then search for and push the New York time switch. "World Clock" is a simple zone time display clock having a mechanical rotary portion arranged in such a manner that when the rotary switch is rotated by each contact, the indication of time advances or retreats by 1 hour and the energized indicator lamps (twenty-four lamps in total) showing a time zone on the world map shift one by one, whereby the indicated time and the corresponding time zone may be known. In the case of finding the time of another place different from the "home" zone where the clock is used and resetting the time indication to the "home" zone, one should search the desired zone by rotating the rotary switch referring to the energized indicator lamp on the world map and then repeat similar operations to reset the time indication.

There have been proposed no zone time display clocks which can also indicate selectively the difference of date with respect to the "home" zone instantly by the command of a user as well as the time of the designated zone.

An object of the present invention is to provide a novel zone time display clock which has solved the inconveniences and problems in the conventional zone time display clock.

Another object of the present invention is to provide a zone time display clock which can display instantly the date and time of an appointed zone or locality and the whole area of the time zone selectively only by appointing a desired zone, requiring no knowledge of the difference in time and date or mental calculation.

A further object of the present invention is to provide a zone time display clock in which the designation of a desired zone can be done by only pointing out the portion of a desired zone or a world map or a place list by finger or by a simple but special pen.

Another object of the present invention is to provide a zone time display clock which can selectively display the whole zone including the designated locality on a world map or a place list separately from other time zones for the purpose of confirming the designated zone, displaying the zone time and indicating the correspondence of the displayed time and the applicable zone of the displayed time.

Another object of the present invention is to provide a zone time display clock which can correctly indicate the difference in date based on the reference to the "home" zone which may be set to any part of the world: For example, the time of 20th, 2:00 p.m. in New York in equal to the time of 21st, 4:00 p.m. in Japan. In this case, when the clock is used in New York and Japan is appointed, the date and time indication will be +1 day 4:00 p.m., tomorrow 4:00 p.m., 21, 4:00 p.m., etc. When it is used in Japan and New York is appointed, the indication will become −1 day 2:00 p.m., yesterday 2:00 p.m., 20, 2:00 p.m., etc. Thus the clock displays the correct date and time at either New York and Japan by exchanging the "home" zone setting switch.

There are some zones in the world such as U.S.A., Canada or India where summer time or day light saving time is adopted. Thus, another object of the present invention is to provide a zone time display clock in which the summer time setting can be done independently in the respective zones and the summer time indication can be done.

Another object of the present invention is to provide a zone time display clock having one time indication panel which is automatically reset to the time indication of the "home" zone when a certain time has passed since a desired zone was pointed out, as is the case in the world timepiece proposed by Miller.

A further object of the present invention is to provide a zone time display clock capable of achieving all of the said objects and a simple zone time display clock capable of achieving part of said objects according to necessity.

According to an embodiment of the present invention, there is provided a zone time display clock comprising zone appointing and displaying means having touch detecting terminals disposed at positions of a map carrying localities and coupled with a time zone display for selectively displaying a time zone;

touch switch means for memorizing a touched position and activating the time zone display and the time difference generating circuit;

a time difference generating circuit for alternately supplying a time difference signal corresponding to the locality stored in the touch switch means and a time difference signal for the "home" place with a synchronizing signal to the time difference calculation circuit;

a time calculation circuit and a date difference calculation circuit for caluculating the time and the date difference from the reference time supplied from a reference electronic clock and the time difference supplied from the time difference generating circuit; and a display driving circuit for displaying the date difference and the time in a display means by the outputs of said circuits;

whereby when a touch detecting terminal on the map or the list is touched with a finger, etc., the display clock indicates the date, the time and the time zone of the touched locality.

Other objects, features and advantages of the present invention will become apparent from the following detailed description taken in conjunction with the accompanying drawings, in which:

FIG. 2 illustrates the calculation of the difference in date and of a.m./p.m. exchange;

Figure 1:
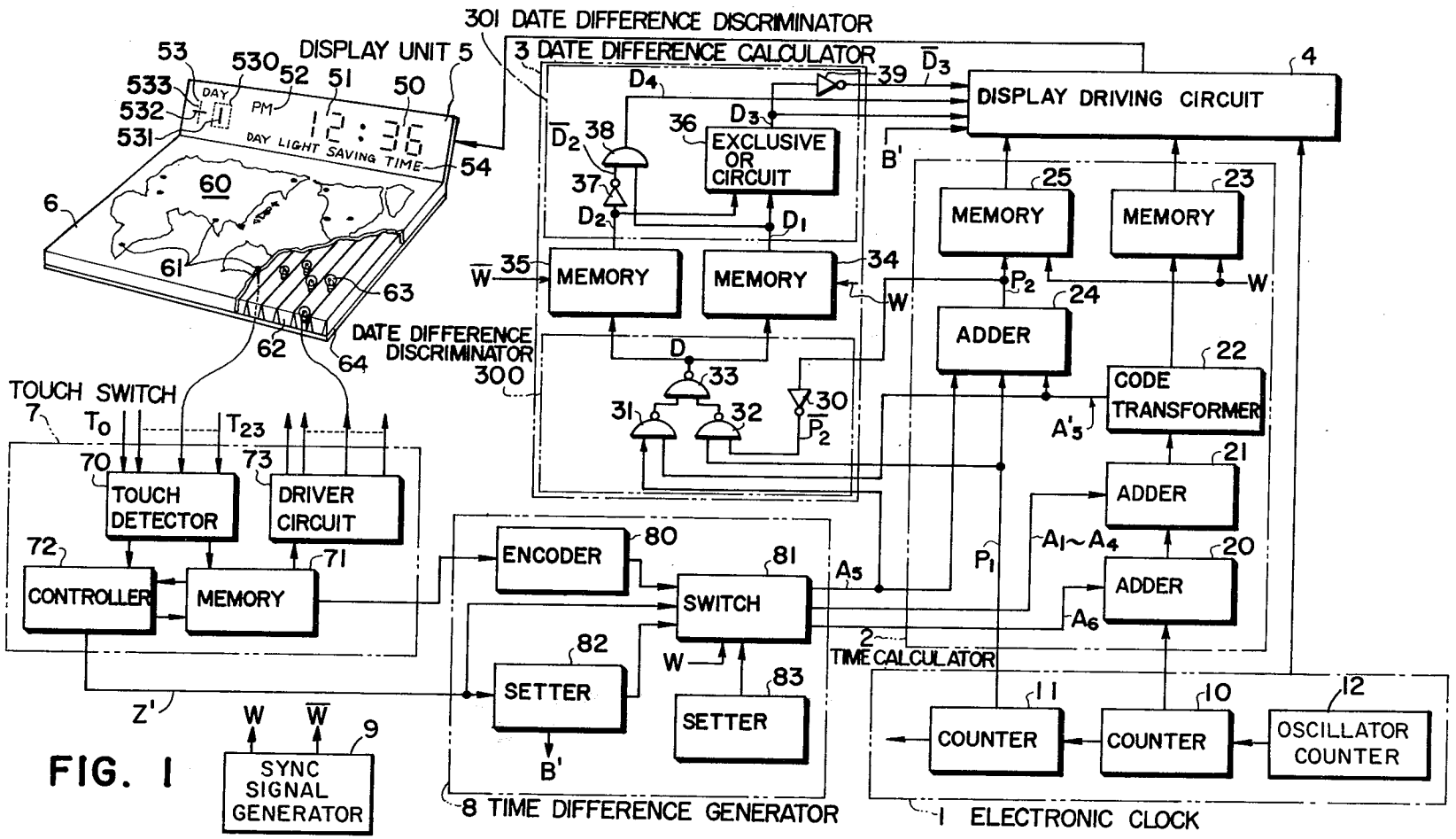
FIG. 1 is a block diagram of an embodiment of a world zone time display clock according to this invention.

An embodiment of a zone time display clock according to this invention is shown in FIG. 1. The zone time display clock comprises an electronic clock 1 for incrementally progressing the time of a reference zone in binary code, a time calculation circuit 2 for calculating the time of an appointed locality on the basis of the inputs of a reference clock signal from the reference clock 1 and a time difference signal from a time difference generating circuit 8, a date difference calculator circuit 3 for calculating the date difference on the basis of the time difference signal and the signal from the time calculator circuit 2, a display driving circuit 4 for reading the time and the date difference signal and displaying the time and the date difference in the display, a display unit 5 for displaying the time, the date difference, the summer time indication, etc., a zone appointing and displaying unit 6 capable of selectively displaying a time zone on a world map when the portion carrying a desired zone in a world map is touched by a finger, etc., a touch switch means 7 for detecting and memorizing the touched portion and activating the time zone indication of the display 6 and the time difference generating circuit 8, and a time difference generating circuit 8 for alternately supplying the time difference signal between the memorized locality (appointed place) and the reference place and the time difference signal between the "home" place of the clock and the reference place to the calculator circuits 2 and 3.

The electronic clock 1 is a standard or reference clock marking the time at the zone GMT-12H and includes an oscillator/counter 12 which frequency-divides a generated reference frequency $f$, to supply signals representing minutes and seconds to the display driver circuit 4 and supply signal representing hours to a duodecimal counter 10, and an AM/PM counter 11. The arrangement of such a standard clock is publicly known. The reason for selecting the time of the zone GMT-12H as the reference is that all the other zone times in the world advance forward from this time and thus the date difference has only two possibilities, i.e.

the same day and the next day, so that the structure of the date difference calculator circuit 3 will become simpler.

The time calculator circuit 2 comprises a summer time indicating adder circuit 20 for adding one hour to the reference time signal derived from the duodecimal (o'clock) counter 10 under the order of a summer time signal $A_6$ from the time difference generating circuit 8, an adder circuit 21 for adding the output of the adder circuit 20 and the time difference signal $A_1$ to $A_4$ (binary signals representing a number corresponding to zero to eleven hours) derived from the time difference generating circuit 8, a code transformer circuit 22 for supplying a signal $A'_5$ discriminating whether the addition time is above 12 o'clock or not and binary signals expressing a two figures number of a decimal system corresponding to one to 12 o'clock, a memory circuit 23 for reading and storing these binary signals with a synchronizing signal w, an a.m./p.m. adder circuit 24 for adding the discriminating signal $A'_5$ indicating whether the result of the addition is above twelve o'clock or not, a signal $A_5$ from the time difference generating circuit 8 indicating whether the time difference is above 12 hours or not and the a.m./p.m. signal of the reference time from the a.m./p.m. counter 11, and a memory circuit 25 for reading and storing the output of the adder circuit 24 with the synchronizing signal W, which thereby adds the time difference generated in the time difference generating circuit 8 and the reference time and supplies the time signal of the appointed place to the display driving circuit with the synchronizing signal W.

The synchronizing signals are supplied from a synchronizing signal generation circuit 9, which produces signals W and W for synchronizing a switching circuit 81 of a time difference generation circuit 8 to be described later, memory circuits 23 and 25 of the time difference calculation circuit 2, and memory circuits 34 and 35 of the date difference calculation circuit 3, with each other.

The date difference calculator circuit 3 comprises a date difference discriminator circuit 300 with respect to the reference place including a NOT circuit 30, and NAND circuits 31, 32 and 33, and a date difference discriminator circuit 301 with respect to the "home" (use) place including a memory circuit 34 for storing the date difference of the appointed place from the reference place, a memory circuit 35 for storing the date difference of the "home" place from the reference place, an exclusive OR circuit 36, NOT circuits 37 and 39, and an AND circuit 38. More particularly, the date difference discriminating circuit 300 comprises a NAND circuit 31 receiving the signal $A_5$ from the time difference generating circuit 8 indicating whether the time difference is above 12 hours or not, and the signal $A_5'$ from the code transformer circuit 22 indicating whether the addition result is above 12 hours or not, a NAND circuit 32 receiving the output $P_1$ of the a.m./p.m. counter 11 and the signal $\overline{P_2}$ formed of the output of the a.m./p.m. adder circuit 24 but inverted through the NOT circuit 30, and a NAND circuit 33 receiving the outputs of the NAND circuits 31 and 32. The output D of the NAND circuit 33 in stored in the memories 34 and 35 by the synchronizing signals $\overline{W}$ and $\overline{W}$, respectively. The date difference calculating circuit 300 achieves the logic operation of $D = A_5A_5' + P_1\overline{P_2}$. The date difference discriminating circuit 301 comprises the exclusive OR circuit 36 receiving the output $D_1$ of the memory circuit 34 for the date difference of the appointed place from the reference place and the output $D_2$ of the memory circuit 35 for the date difference of the "home" place from the reference place, the AND circuit 38 receiving the signal $\overline{D_1}$ and the signal $D_2$ formed of the signal $D_2$ but inverted in the NOT circuit 37, and the NOT circuit 39 for inverting the output $D_3$ of the exclusive OR circuit 36 to generate the signal $\overline{D}_3$. The output $D_3$ of the exclusive OR circuit 36 is expressed by the logic equation of $D_3 = D_1 D_2 + \overline{D_1} D_2$ and corresponds to the date difference of O or 1 day of the appointed place with respect to the "home" place. The output $D_4$ of the AND circuit 38 is expressed by the logic equation of $D_4 = D_1 \overline{D_2}$ and corresponds to the advance or retreat of the date. Circuit arrangement of the display driving circuit 4 is done in such a manner that a figure display 530 (0 shown in dotted line) in a date display portion 53 in the display panel 5 is lighted when $\overline{D_3} = 1$, a figure display 531 (1 shown in a solid line) and a sign display portion 532 (- shown in solid line) are lit when $D_3 = 1$ and a sign display portion 533 (1 shown in dotted line) is lit when $D_4 = 1$. Then, the date difference of $-1$ ($D_3 = 1$ and $D_4 = 0$ indicating that the date of the appointed place is one day behind the date of the "home" place), 0 ($D_3 = 0$ and $D_4 = 0$ indicating that the date of the appointed place is same as that of the "home" place) and $+1$ ($D_3 = 1$ and $D_4 = 1$ indicating that the date of the appointed place advances one day from that of the "home" place) with respect to the "home" place can be displayed in the display panel.

Next, the principles of the structure of such time and date difference calculation will be described referring to FIG. 2. A 24 hours system will be adopted in which the reference time X varies from 0 to 23 o'clock (0 o'clock corresponds to 12 o'clock a.m.) and the time difference Y from the reference time varies from 0 to 23 hours. In order to display the time in familiar a.m./p.m. 12 hours system and to simplify the circuit structure, the signals X and Y will be represented by signals ($x$, $P_1$) and ($y$, $A_5$), where $x$ and $y$ are duodecimal signals. Namely, when $X < 12$, $x = X$ (0 to 11) and $P_1 = 0$ and when $X \geqq 12$, $x = X - 12$ and $P_1 = 1$. Then, $P_1 = 0$ corresponds to a.m. and $P_1 = 1$ corresponds to p.m. Similarly, $y = 0$ to 11, when $Y < 12$, ($y = Y$, $A_5 = 0$) and when $Y \geqq 12$, ($y = Y - 12$, $A_5 = 1$). The arithmetic rules are listed in FIG. 2 in which the discrimination signal of whether $x + y < 12$ or $x + y \geqq 12$ is denoted by $A'_5$ (when $x + y \geqq 12$, $A'_5 = 1$), the a.m./p.m. signal formed by the addition of the reference time X and the time difference Y is denoted by $P_2$ ($P_2 = 1$ corresponds to p.m.), and the date difference with respect to the reference place is denoted by D ($D = 0$ for the same day and $D = 1$ for one day advance).

In FIG. 2, the left end column represents the four possibilities of the addition of the reference time and the time difference $X + Y$, the second column from the left end denotes the date difference D, the third column denotes a.m./p.m. as a result of the addition, the fourth column shows the time — indicating figures in the twelve hours system with a clear correspondence between X, Y and $x$, $y$, the fifth column denotes the a.m./p.m. signal $P_1$ of the reference time, the sixth column denotes the signal $A_5$ representing whether the time difference Y is above 12 or not and the seventh (right end) column denotes the signal $A'_5$ representing whether $x + y$ is above 12 or not. In the case of the first possibility (if $1° X + Y < 12$), the time of the appointed place is in the same day ($D = 0$), a.m. ($P_2 = 0$) and $X + Y$ o'clock ($= x + y$ o'clock), and the a.m./p.m. of the reference time is a.m. ($P_1 = 0$). Regarding the time difference, since $Y < 12$, $A_5 = 0$ and since $x + y < 12$, $A_5' = 0$. In the case of $2° 24 > X + Y \geqq 12$, the time of the appointed place is in the same day, p.m. and $X + Y - 12$ o'clock. This case includes three possibilities: (1) $X < 12$ and $Y < 12$ (since $X = X$, $P_1 = 0$, $y = Y$ and $A_5 = 0$, $X + Y - 12 = x + y - 12$ and $x + y \geqq 12$, i.e. $A'_5 = 1$); and (2) $X \geqq 12$ or $Y \geqq 12$ (if $x = X - 12$, $P_1 = 1$, $X + Y - 12 = (X - 12) + Y = x + y$ and hence $x + y < 12$, i.e. $A_5' = 0$, or if $y = Y - 12$, $A_5 = 1$, $X + Y - 12 = X + (Y - 12) = x + y$ and hence $x + y < 12$, i.e. $A'_5 = 0$). Similarly, the cases of $3° 36 > X + Y \geqq 24$ and $4° 48 > X + Y \geqq 36$ are listed.

From this table, $P_2 = P_1 (A_5 \overline{A_5'} + \overline{A_5} A_5') + \overline{P_1} (A_5 \overline{A_5'} + \overline{A_5} A_5') = P_1 (\overline{A_5 \oplus A_5'}) + P_2 (A_5 \oplus A_5') = P_1 \oplus A_5 \oplus A_5'$ and $D = P_1 (A_5 + A_5') + A_5 A_5'$ can be obtained by use of the Karnaugh. Alternatively, $D = \overline{P_1} P_2 + A_5 A_5'$ can be obtained from $P_2$, $P_1$, $A_5$ and $A_5'$.

An embodiment of the concrete circuit for carrying out the above logic is the adder circuit 24 and the date difference discriminating circuit 300 with respect to the reference place in the date difference calculator circuit 3 shown in FIG. 1.

The display driving circuit 4 receives the time signal, the date difference signal, the summer time display signal, etc. and drives, for example, a liquid crystal display unit 5 to carry out the predetermined display.

The display unit 5 may be formed of a liquid crystal display unit and includes the a.m./p.m. indicator 52, the clock hour display 51, the minutes display 50, the summer time indicator 54 and the date difference indicator 53.

The zone appointing and displaying unit 6 is formed of a semi-transparent plate 60 printed with a world map, metal pins 61 disposed at the representative cities in the world and working as the indication of the city location and the touch detecting terminal, light chambers 62 disposed under the world map 60 for illuminating the time zone, lamps 63 disposed in the light chambers, and a printed circuit board 64 for connecting the multiplicity of pins 61 and lamps 63 to a touch switch circuit 7. The heads of the metal pins 61 are extruded above the surface of the plate 60 printed with a world map at the representative cities, countries and zones of the world so that they can be touched by a finger. The legs of the pins 61 penetrate through the plate 60 and the light chambers 62 and are connected to the printed circuit board 64. The legs of the pins in a time zone are connected in common on the print circuit board 64 to an input terminal of the touch switch 7. Each of the light chamber 62 has a light diffusing surface on the top surface which is shaped like the shape of corresponding time zone. The side and bottom surfaces of each light chamber 62 are coated with a reflecting material and formed in an appropriate shape prevent to the leak of light to the adjacent light chambers and to illuminate the upper surfaces uniformly. A multiplicity of such light chambers 62 are disposed under the semitransparent plate 60 printed with a world map. In each of these light chamber at least one lamp is disposed according to the area and shape of the upper surface representing a time zone so that the upper surface lights up uniformly. The lamps belonging to a same time zone are connected in common on the printed circuit board 64 to the same output terminal of a time zone display driving circuit 73 of the touch switch 7.

The touch switch 7 comprises a touch detector circuit 70 connected to a multiplicity of the touch detecting terminals 61 of the zone display and appointing unit 6 for detecting that a touch detecting terminal is touched and which terminal is touched (i.e. which time zone is appointed) an appointment memory circuit 71 for memorizing the output of the touch detector circuit 70 (the signal of which time zone is appointed), a control circuit 72 for the memory 71 for preventing an error memory in the case where the touch detecting terminals of two or more different time zones are touched or an error memory due to noise and for erasing the memory after a predetermined time, and a time zone display driving circuit 73 for activating the time zone display corresponding to the place of zone memorized in the appointment memory circuit 71, i.e. the lamp group in the light chamber of the time zone including the appointed locality.

Figure 3:
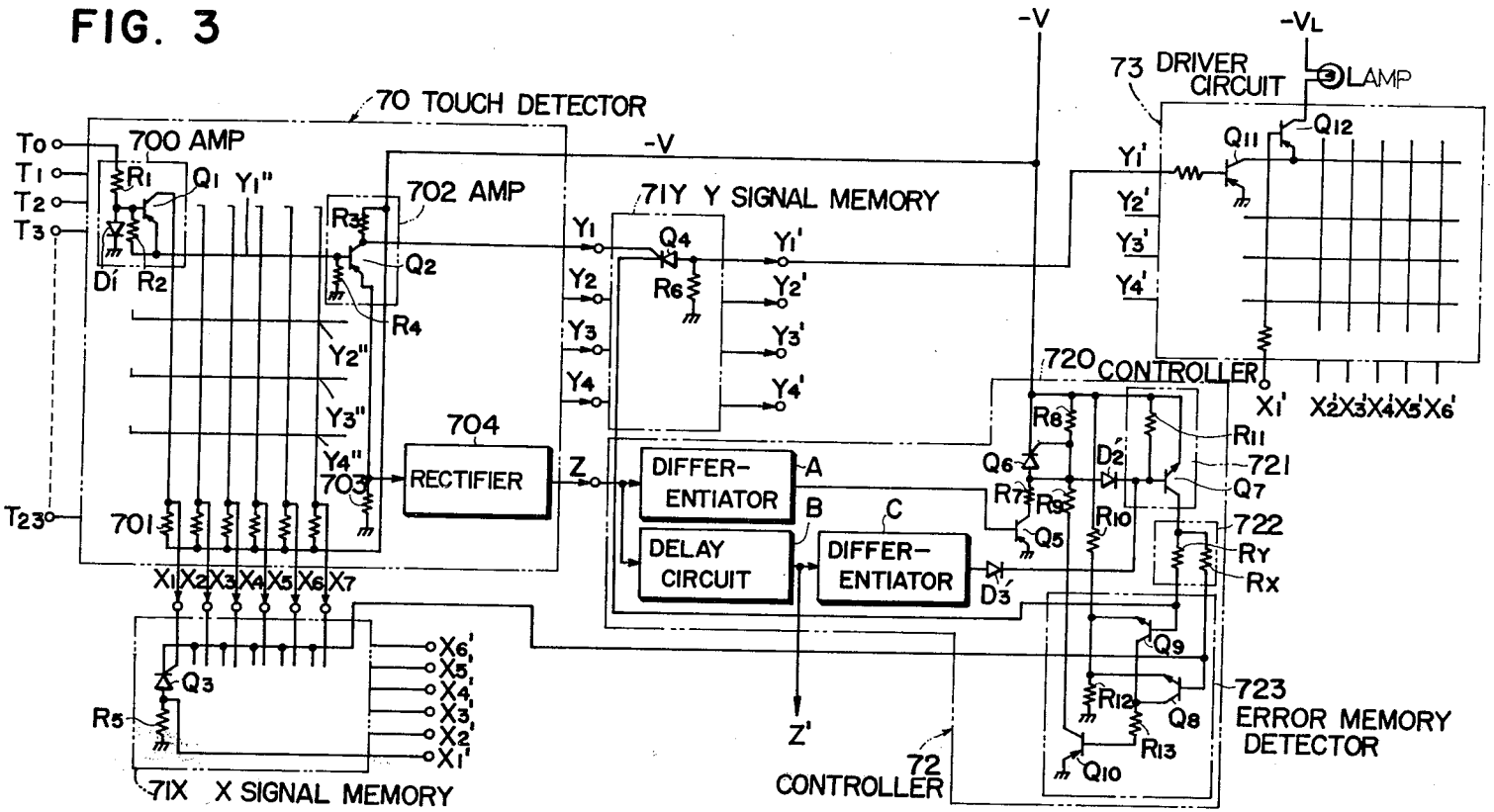
FIG. 3 is a detailed electric circuit diagram of a touch switch unit.

A concrete embodiment of the touch switch circuit 7 is shown in FIG. 3. The touch detector circuit 70 generates the signal ($X_i$, $Y_j$) ($i = 1$ to $6, j = 1$ to 4) representing which input terminal is touched and the signal Z representing that one of the input terminals is touched from a multiplicity of inputs $T_0$ to $T_{23}$ to 24 time zones which are different by one hour). A high input impedance amplifier 700 consists of a protecting resistor $R_1$, a protecting diode $D_1'$, a base-emitter resistor $R_2$ and a PNP transistor $Q_1$. A multiplicity of amplifiers similar to the amplifier 700 form an X Y matrix with the collectors forming columns and the emitters forming rows. The signal generated in a common collector resistance 701 of the $X_1$ column is denoted by signal $X_1$. Signals $X_2$, $X_3$, $X_4$, $X_5$ and $X_6$ are defined similarly. The common line of the $Y_1''$ row is connected to the base of the transistor $Q_2$ of a voltage amplifier 702. Similar amplifiers to the amplifier 702 are connected similarly to the common lines $Y_2$, $Y_3$ and $Y_4$. Signals generated in the collector resistors $R_3$ for the transistors $Q_2$ of the voltage amplifiers 702 connected to lines $Y_1$ to $Y_4$ form signals $Y_1$ to $Y_4$, and the emitters of the transistors $Q_2$ are connected to a common resistor 703. Circuit 704 amplifies the signal generated in the common emitter resistor 703, and rectifies it to generate a constant dc voltage from the moment when any one of the input terminals $T_0$ to $T_{23}$ is touched and for as long as it is touched.

An X signal memory circuit 71 X of the appointment memory circuit 71 consists of six unit circuits, each consisting of an SCR $Q_3$ and a resistor $R_5$. The gate of each SCR $Q_3$ is connected to one of the output terminals $X_1$ to $X_6$ of the touch detecting circuit. The outputs $X_1'$ to $X_6'$ of the memory are derived from the anodes of the SCR's $Q_3$. The cathodes of the SCR's $Q_3$ are connected in common to a resistor $R_X$ in the control circuit 72. A Y signal memory circuit 71 Y of the appointment memory circuit 71 has similar unit circuits as those of the circuit 71X, the gates of the respective SCR's $Q_4$ are connected to the output lines $Y_1$ to $Y_4$, the cathodes of the SCR's $Q_4$ are connected in common to a resistor $R_Y$ in the controller circuit 72, and outputs $Y_1'$ to $Y_4'$ are derived from the anodes.

The controller circuit 72 consists of an electronic switch control circuit 720, an electronic switch 721, a biasing circuit 722, and an error memory detecting circuit 723.

The control circuit 720 for the electronic switch 721 cuts off the electronic switch 721 at the moment when a touch signal is generated in the output Z (a dc voltage generated during a touch signal is applied to any one of the inputs) of the touch detecting circuit 70. The control circuit 720 also cuts off the electronic switch 721 when an error memory signal is generated in the output of the error memory detecting circuit 723, and maintains the switch 721 being cut off until a touch signal is applied again. Further, the control circuit 720 cuts off the switch 721 after a predetermined time has passed from the disappearance of the touch signal.

The output Z of the touch detecting circuit 70 is applied to a differentiator circuit A and a delay circuit B. The output of the differentiator circuit A is connected to the base of a transistor $Q_5$. The emitter and the collector of the transistor $Q_5$ are connected to the earth line and to the anodes of a SCR $Q_6$ and a diode $D_2'$ through a current limiting resistor $R_7$, respectively. The cathode of the SCR $Q_6$ is connected to a voltage source line −V. The gate thereof is connected to the voltage source line and the collector of a transistor $Q_{10}$ through resistors $R_8$ and $R_9$, respectively. The cathode of the diode $D_2'$ is connected to the base of a transistor $Q_7$ in the electronic switching circuit 721. The output Z' of the delay circuit B is differentiated in a differentiator circuit C and this differentiated pulse is applied to the base of the transistor $Q_7$ through a diode $D_3'$.

The electronic switch 721 consists of a transistor $Q_7$ and a resistor $R_{11}$. The emitter, collector and the base of the transistor $Q_7$ are connected to the voltage source line −V, to resistors $R_X$ and $R_Y$ in the biasing circuit 722, and to the voltage source line −V through the resistor $R_{11}$ and the cathodes of the diodes $D_2'$ and $D_3'$, respectively. The biasing circuit 722 consists of resistors $R_X$ and $R_Y$. One end of the resistors $R_X$ and $R_Y$ is connected to the collector of each of the transistor $Q_7$ of the electronic switch 721 in common and the other ends are connected to the cathodes of the SCR in the memory circuits 71 X and 71 Y and the bases of the transistors $Q_8$ and $Q_9$ of the error memory detecting circuit 723. The values of resistances $R_X$ and $R_Y$ are selected in such a manner that when each one SCR in the circuits 71 X and 71Y is turned on the voltage generated across the resistors $R_X$ and $R_Y$ should become larger than the maximum voltage of the outputs $X_i$ and $X_j$ of the touch detecting circuit 70. When at least each one SCR of the circuits 71X and 71Y is turned on, the cathode voltage of the SCR's is higher than the touch signal level applied to the gate of the SCR and the gates of the SCR's in the circuit 71X and 71Y are reversely biased. While this reverse bias is applied to the SCR's, any other SCR does not turn on even if a signal ($X_i$, $Y_j$) is applied from the touch detecting circuit 70. Namely, when an SCR is turned on by a touch signal, any other signal ($X_i$, $Y_j$) arriving thereaafter cannot turn on the corresponding SCR unless all the SCR's are turned off and the SCR corresponding to the earlier signal ($X_i'$, $Y_j'$) is kept turned on.

There exists a minimum value of the signal energy generated across the resistor 703 and a time delay for generating a dc voltage in the output Z of the amplifying rectifier 704 by the touch signal generated across the resistor 703 in the touch detecting circuit 70. When a dc voltage is generated in the output Z, the normally turned-on transistor is momentarily turned off by the output of the differentiator circuit A, hence the electronic switch 721 is momentarily opened and thereby all the SCR's in the memory circuits 71X and 71Y are turned off. As a result, the bias voltages of the resistors $R_X$ and $R_Y$ in the biasing circuit 722 disappear and an SCR corresponding to the output ($X_i$, $Y_j$) from the touch detecting circuit will be turned on. Namely, the appointed zone is memorized. However, if a touch signal which cannot generate a dc voltage in the output Z, i.e. a noise, is transmitted from the touch detecting circuit to the memory circuit, it is not memorized in the memory circuit by the virtue of the biasing circuit 722. Namely, even if a signal may be generated from the touch detecting circuit by noise due to induction, etc., it is not memorized. Further, when two or more touch signals are generated by an error, the SCR corresponding to the first generated touch signal is turned on but the SCR corresponding to the touch signal generated thereafter is not turned on if they are generated with such a time difference that no separated signals can be generated in the output Z. Namely, only the touch signal generated first can be stored in the memory circuit. Thus, the biasing circuit 722 achieves the prevention of an error memory and the priority storing of the touch signal in conjunction with the amplifying rectifier circuit (also having the function of a filter) 704 and the electronic switch 721. The biasing circuit 722 also generates an error memory signal. When two or more touch signals are generated at exactly the same time, three or more SCR's corresponding to the respective touch signals are turned on. Namely, an error memory occurs. In this case, the voltages generated across the resistors $R_X$ and $R_Y$ in the biasing circuit 722 becomes larger than those of the normal case. The error memory detecting circuit 723 detects this state and cut off the electronic switch 721 and all the SCR's in the memory circuits 71X and 71Y. The bases of the transistors $Q_8$ $Q_9$ are connected to the cathodes of the SCR's in the memory circuits 71X and 71Y, respectively. The emitters of the transistors $Q_8$ and $Q_9$ are both connected to the voltage source line −V through a resistor $R_{10}$ and to the earth line through a resistor $R_{12}$. The collectors of the transistors $Q_8$ and $Q_9$ are both connected to the base of a transistor $Q_{10}$ through a resistor $R_{13}$. The emitter and the collector of the transistor $Q_{10}$ are connected to the earth line, and to the SCR $Q_6$ through a resistor $R_9$, respectively. When a voltage exceeding a certain voltage determined by the emitter voltage divided by the resistors $R_{10}$ and $R_{12}$ is generated in the base voltages of the transistors $Q_8$ and/or $Q_9$, i.e. at least one of the resistors $R_X$ and $R_Y$, at least one of the transistors $Q_8$ and $Q_9$ is turned on, which then turns on the transistor $Q_{10}$. When the transistor $Q_{10}$ is turned on, a voltage is established across the resistor $R_8$ in the electronic switch control circuit 720 and turns on the SCR $Q_6$. When the SCR $Q_6$ is turned on, the base-emitter voltage for the transistor $Q_7$ in the electronic switch 721 decreases and the transistor $Q_7$ becomes cut off. The cut-off of the switching transistor $Q_7$ leads all the SCR's in the memory circuits to be cut off. Thus, the voltage drop across the resistors $R_X$ and $R_Y$ reduces to zero, but the SCR $Q_6$ remains turned on. Therefore, the electronic switch 721 remains turned off. This state may be detected to activate an error indicator. For example, a lamp, etc. (not shown in FIG. 3) may be inserted in the place of the resistor $R_7$. As is described above, when two or more touch signals are generated at exactly the same moment, the SCR's in the memory circuits are instantly cut off and remain cut off.

When the user notices the error and generates another touch signal, the transistor $Q_5$ is momentarily turned off by the output of the differentiator circuit A and the SCR $Q_6$ is turned off, thereby the electronic switch 721 is turned on and the SCR's in the memory circuits corresponding to the touch signal are turned on to store the touch. The reason of cutting off the electronic switch $Q_7$ by the SCR $Q_6$ is that an oscillation may arise in the closed loop of the electronic switch 721, the biasing circuit 722, the error memory detecting circuit 723 and the electronic switch controlling circuit 720. Thus, the use of SCR $Q_6$ prevents the possible oscillation in the case where a user continues to generate two or more signals unintentionally.

The time zone display driving circuit 73 is a transistor switching circuit which receives the outputs $X_1'$ to $X_6'$ and $Y_1'$ to $Y_4'$ of the memory circuits 71X and 71Y as the inputs and selectively turns on or off the lamps (denoted by 63 in FIG. 1) in the time zone display. The arrangement of such a circuit is well known as is shown by 73 in FIG. 3 and comprises a matrix of the base-emitter of transistors $Q_{12}$ connected to the lamp groups corresponding to the respective time zones and transistors $Q_{11}$ for switching the emitter side thereof.

Now, the operation of the touch switch circuit will be described. In the case of driving this zone time display clock by an ac power source, when a user touches an input terminal, for example $T_0$, of the touch detecting circuit 70 with his finger, an inducted hum current is allowed to flow through resistors $R_1$ and $R_2$ and the base of a transistor $Q_1$. This current is amplified through the transistors $Q_1$ and $Q_2$ to generate hum voltages across the collector resistors 701 and $R_3$ for the transistors $Q_1$ and $Q_2$ and across the emitter resistor 703 for the transistor $Q_2$. The hum voltages across the resistors 701 and $R_3$ correspond to the signals $X_1$ and $Y_1$ and are applied to the gates of the corresponding SCR's in the memory circuits 71X and 71Y. On the other hand, the hum voltage across the resistor 703 generates a dc voltage in the output Z of the amplifying rectifier 704. By this dc voltage, all the SCR's in the memory circuits 71X and 71Y are once turned off by the memory control circuit 72 and then SCR's corresponding to the signal ($X_1$, $Y_1$) are turned on as is described above. Thus, the fact that the input terminal $T_0$ is touched is stored in the memory and the lamp corresponding to the input terminal $T_0$ is lighted by the time zone display driving circuit 73. Further, a corresponding time difference is generated in the time difference generating circuit 8.

When two input terminals are touched by error, hum voltages corresponding to two combinations ($X_i$, $Y_j$) and (Xm, Yn) and a dc voltage in the output Z are generated in a similar manner. If there exists a certain time difference between these touches, however, the earlier touch is stored and if the two touches are at exactly the same moment, all the SCR's in the memory circuits are turned off as is described above. Since the touch detecting circuit has a high input impedance, it easily generates an output signal by a induced noise, etc. but the signals due to noise are not stored as described above.

The time difference generating circuit 8 consists of a time difference encoder 80 connected to the output of the memory circuit 71 of the touch switch circuit 7, a switching circuit 81 for alternately exchanging the time difference signal of an appointed place which is the output of the encoder 80 and the time difference signal of the use place derived from a use place setting circuit 83 and supplying the signal to the calculation circuits 2 and 3, a summer time setting circuit 82, and a home setting circuit 83. A concrete embodiment of the time difference generating circuit 8 is shown in FIG. 4.

Figure 4:
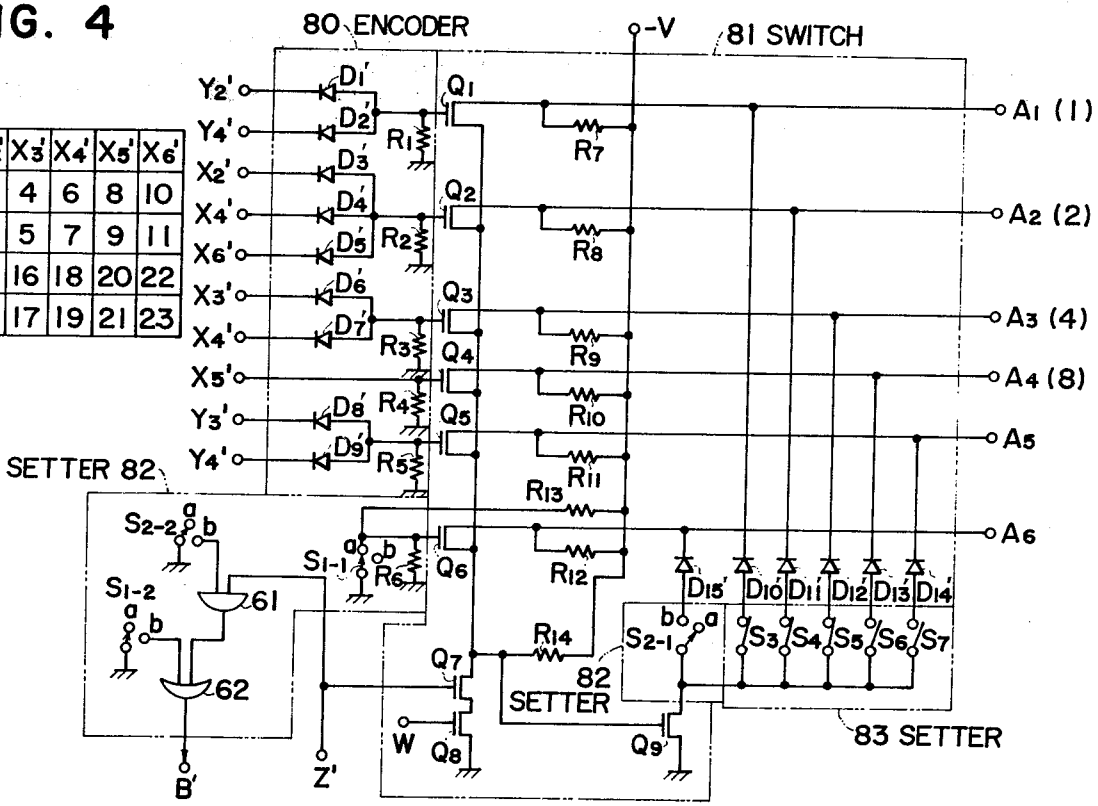
FIG. 4 is a detailed electric circuit diagram of a time difference generating circuit.

The table in the left upper portion of FIG. 4 shows the correspondence between the combination of the outputs $X_1'$ to $X_6'$ and $Y_1'$ to $Y_4'$ of the memory circuit 71 and the time difference. For example, if the signal ($X_2'$, $Y_2'$) becomes a negative voltage, the time difference is 3 hours. The time difference encoder transforms such values as listed in the said table into a binary signal of 5 bits bearing a duodecimal figure. The encoder 80 is a known OR circuit of the negative logic consisting of diodes $D_1'$ to $D_9'$ and resistors $R_1$ to $R_5$. Since the touch switch 7 is arranged to generate a two dimensional output of X and Y, the number of diodes for the encoder can be very small.

The switching circuit 81 consists of MOS transistors $Q_1$ to $Q_6$ the respective gates of which are connected to the resistors $R_1$ to $R_5$ of the encoder 80 and a resistor $R_6$ of the summer time setting circuit 82, drain resistors $R_7$ to $R_{12}$ and diodes $D_{10}'$ to $D_{15}'$ connected to the drains of the MOS transistors $Q_1$ to $Q_6$, MOS transistors $Q_7$ and $Q_8$ connected to the sources of the MOOS transistors $Q_1$ to $Q_6$ in common, and a MOS transistor $Q_9$ connected to one side of switches $S_3$ to $S_6$ of the home setting circuit 83 and one side of a summer time setting switch $S_{2-}$ in common. The drain, the source and the gate of the MOS transistor $Q_7$ are connected to the sources of the MOS transistors $Q_1$ to $Q_6$, to the drain of the MOS transistor $Q_8$, and to the output Z' of the delay circuit B of the touch switch circuit 7. The sources and gates of the MOS transistors $Q_8$ and $Q_9$ are connected to the earth line, and to the synchronizing signal W and the drain of the MOS transistor $Q_7$, respectively.

The summer time setting circuit 82 consists of switches $S_{1-1}$ and $S_{2-1}$ for advancing the time by 1 hour, switches $S_{1-2}$ and $S_{2-2}$ for displaying that it is summer time, an AND circuit 61, and an OR circuit 62. The switches $S_{1-1}$ and $S_{1-2}$ and the switches $S_{2-1}$ and $S_{2-2}$ are interlocked switches for setting the summer time at the appointed place and at the use place, respectively. The switch $S_{1-1}$ turns on and off the connection between a terminal a connected to the gate of the MOS transistor $Q_6$ of the switch circuit 81 and to the voltage source line −V through a resistor $R_{13}$, and the earth line. When the switch $S_{1-1}$ is cut off, i.e. in the position *b*, the summer time is set. The switch $S_{2-1}$ turns on and off the connection between the anode of a diode $D_{15}'$ and the drain of the transistor $Q_9$. When it is closed, i.e. in the position *b*), the summer time is set. The switch $S_{2-2}$ turns on and off the connection between the input of the AND circuit 61 and the earth line. The switch $S_{1-2}$ turns on and off the connection between the input of the OR circuit 62 and the earth line. Both of the switches $S_{2-2}$ and $S_{1-1}$ set the summer time in the closed position *b*. The other input of the AND circuit 61 is connected to the output Z' of the delay circuit B of the touch switch circuit 7 and the output is connected to the other input of the OR circuit 62. The output B' of the OR circuit 62 is connected to the display driving circuit 4.

The use place setting circuit 83 is formed of a group of five switches $S_3$ to $S_7$, the one sides of which are connected to the drain of the transistor $Q_9$ in common and the other sides of which are connected to the drains of the transistors $Q_1$ to $Q_5$ through the diodes $D_{10}'$ to $D_{14}'$, respectively. The time difference output is derived as $A_1$ to $A_4$ (weighted by factors 1, 2, 4 and 8) and $A_5$ (discriminating whether the time difference is above twelve hours or not) from the drains of the transistors $Q_1$ to $Q_5$, and $A_6$ (indicating whether it is in the summer time or not) from the drain of the transistor $Q_6$.

Next, the operation will be described. In the case where no negative voltage is established at the output Z', the transistor $Q_7$ is turned off, hence all the transistors $Q_1$ to $Q_6$ are turned off, and since the negative voltage −V is applied to the gate of the transistor $Q_9$, the transistor $Q_9$ is turned on. Thus, the time difference signals (the time difference at the "home" place) set by the switches $S_3$ to $S_6$ and $S_{2-1}$ appear at the terminals $A_1$ to $A_5$. For example, when the switches $S_3$, $S_4$ and $S_5$ are closed and the others are open, the time difference is seven hours. Provided that the reference is taken to the zone GMT-12H, this corresponds to the fact that the zone of −12 + 7 = −5H, i.e. New York, is set as the "home" zone.

When an input terminal of the touch switch 7 is touched, a negative voltage is generated in the output Z' and the transistor $Q_7$ becomes turned on. Then, the transistors $Q_8$ and $Q_9$ are alternately turned on and off by the synchronizing pulse W applied to the gate of the transistor $Q_8$. When the transistor $Q_8$ is turned on, the transistor $Q_9$ is turned off and the transistors $Q_1$ to $Q_6$ are turned on or off according to the voltage applied to the gate thereof. Namely, at the drains $A_1$ to $A_6$ of the transistors $Q_1$ to $Q_6$, the time difference signal for the appointed place or zone appears. When the transistor $Q_8$ is turned off, the time difference for the "home" zone appears at the terminals $A_1$ to $A_6$ similar to said case when the transistor $Q_7$ is turned off. Thus, the time difference signal for the appointed place and that for the "home" place are alternately generated on the terminals $A_1$ to $A_6$ by the synchronizing pulse W until the negative voltage at the output Z' vanishes (for a certain time after an input terminal is touched).

The function of the switches for displaying the summer time is as follows. When the time of the "home" zone is displayed in the time display panel, i.e. when the output Z' is zero volts, the summer time indicator is controlled by the position of the switch $S_{2-2}$ for the "home" zone due to the AND circuit 61, but when the time of the appointed place, i.e. when the output Z' is of a negative voltage, due to the character of the AND circuit 61 the summer time indicator cannot be controlled by the position of the switch $S_{2-2}$ for the "home" zone. On the other hand, the summer time switch $S_{1-2}$ for the appointed place can always control the summer time indicator due to the character of the OR circuit 62. When the switch $S_{2-2}$ is at the position *b* and the switch $S_{1-2}$ is at the position *a*, the summer time display is achieved in the case of displaying the time of the "home" zone, but in the case of displaying the time of the appointed place the summer time display disappears and the normal time display is made. When the display returns to the "home" time display, the summer time display reappears. If the switch $S_{1-2}$ is at the position *b*, the summer time display will be done in both cases of displaying the time of the "home" zone and the appointed place.

As has been shown in the above embodiment, a very useful zone time display clock which can display the date difference, the time and the time zone of an appointed place only by touching the portion of the desired place on a world map with a finger can be provided.

The present invention should not be limited to the embodiment described above, but is a zone time display clock comprising: (a) a zone appointing and displaying unit, (b) a touch switch unit, (c) a time difference generating unit, (d) a calculating unit, (e) an electronic clock, and (f) an display unit including a display driving circuit, and featured by the fact that when the position bearing a desired place in the zone appointing and displaying unit is touched with a finger, etc., the time and the time zone of the appointed place is displayed instantly.

(a) Zone appointing and displaying unit:

The zone list, the desired zone indication and the time zone indication are integrated to this unit so that a series of operations for searching for a desired place, appointing a place and confirming the appointment is made very smooth and easy. In place of the world map described in the embodiment, a place list carrying the names of cities, zones and/or countries may be used. A liquid crystal panel, an EL panel, etc. may be used in place of the time zone indication by lamps and light chambers. Further, transparent electrodes formed in the shape of the time zones, etc. may be used in place of the metal pins. Yet further, sensors for ultrasonic waves, lights, temperatures, high frequency waves, etc. disposed under a world map or a place list may be used as the touch detecting terminals.

(b) Touch switch unit:

This is a unit for amplifying a touch signal induced in a touch detecting terminal in the zone appointing and displaying unit when it is touched with a finger, etc., memorizing the touched position, selectively activating the time zone display and generating the time difference signal in a time difference generating circuit corresponding to the touches and memorized locality. Besides the one described in the embodiment, following alternatives or modifications are possible. As the touch signal, a dc voltage or a high frequency voltage can be used besides the hum voltage induced from a finger. For example, using the circuit arrangement of the embodiment it will be apparent that the unit operates normally if one uses a pen having a point connected to the voltage source line -V and touches a touch detecting terminal with the pen point. Further, it will be also apparent that normal operation can be obtained by using a pen containing a battery and an oscillator and applying the oscillation energy of the pen through touching a touch detecting terminal with the pen.

In the embodiment of the touch detecting circuit, the memory circuit, the equal time zone display driving circuit, etc. are formed in X - Y matrices. It is easy to provide a high input impedance amplifier and an SCR circuit and insert a lamp as the load of the SCR at every input terminal. Usual flip-flops, etc. can also be used as the memory elements.

(c) Time difference generating unit:

This unit includes a home setting circuit, a summer time setting circuit, a time difference encoder for the appointed place, and a switching circuit and alternately generates the time differences for the "home" and the appointed place.

(d) Calculator unit:

Although an embodiment for the a.m./p.m. 12 hours system was described, a calculator unit for the 24 hours system can also be realized easily. Further, although only the memory circuits 23 and 25 (c.f. FIG. 1) for storing the output of the time calculation with the synchronizing signal W, if further memory circuits 23' and 25' for storing the output of the time calculation with a synchronizing signal $\overline{W}$ are provided and one more set of the display and the driving circuit is equipped, it is easy to display the time of the "home" place constantly and at the same time to display the time of the appointed place described in the embodiment in another display unit. Namely, a world time piece having two displays and always displaying the time of the "home" place in one display and the time of an appointed place in another display can be easily achieved. In this case, the resetting of the memory circuits by the delay circuit B of the touch switch 7 and the transistor $Q_7$ in the time difference generating circuit, etc. are dispensed with. It is also easy to arrange a structure capable of changing the date indication of the electronic clock 1 by calculating the date signal and the date difference signal instead of directly displaying the date difference by the output of the date difference calculator. For example, when the date in the "home" place is the 10th, the indication of the 9th instead of the date difference indication of −1 day can be achieved by the logic design techniques.

In the embodiment, hum signals are employed as the touch signal so that the system is limited to the use of an ac power source. However, a small size portable zone time display clocks can be achieved by using a dc voltage as the touch signal, appointing a zone with a thin pen point as described above and achieving the time zone display with an indicator of low power consumption such as a liquid crystal indication panel.

What we claim is:

1. A world clock comprising:

a zone appointing and displaying means including an integrated structure of a map divided into a plurality of substantially equal time zones, a plurality of touch detection terminals disposed at locations on said map corresponding to cities or countries, and time zone display devices arranged beneath the map for providing a separate indication of each time zone on the map;

touch switch circuit means, including a touch detection circuit connected to said touch detection terminals for amplifying a designated location signal from a designated touch detection terminal to generate a touch signal at an output terminal corresponding to the location of the touch detection terminal on the map as well as the output terminals corresponding to all of the touch detection terminals, a location memory circuit connected to the output terminal corresponding to said location for storing the designated location, a display driver circuit connected between an output of said location memory circuit and said time zone display devices for activating the time zone display device corresponding to the designated location, and a control circuit connected to the output terminals corresponding to all of the touch detection terminals of the touch detection circuit and the location memory circuit for controlling the operation of the memory circuit;

an electronic clock circuit for generating a reference time signal, corresponding to a reference location, in the form of binary code;

a time difference generation circuit including an encoder circuit connected to the output of said location memory circuit for generating a time difference signal representing the time difference between the designated location and the reference location, a home location setting circuit for generating a signal representing the time difference between a home location and the reference location, and a switching circuit coupled to outputs of said encoder and home location settling circuits;

a time difference calculation circuit, including an adder circuit coupled to the reference electronic clock circuit and the switching circuit of said time difference generation circuit with the time of the store operation in the date difference calculation circuit.

2. A world clock according to claim 1, wherein said touch detection circuit includes amplifying means having a high input impedance coupled to said touch detection terminals for amplifying a human-body-induced AC hum voltage.

3. A world clock according to claim 1, further comprising: an amplifier-rectifier circuit for amplifying and rectifying the touch signals corresponding to all of the touch detection terminals to supply a signal to a control circuit for controlling the operation of the location memory circuit.

4. A world clock according to claim 3, further comprising an error memory circuit coupled to said location memory circuit for preventing erroneous operation in case more than one touch detection terminal is energized simultaneously, including means for clearing said location memory circuit and means coupled to said clearing means for inhibiting writing into said location memory circuit until after a single touch detection terminal is energized.

5. A world clock according to claim 3, further comprising:

a plurality of SCR's each having its gate electrodes coupled to one output of said touch detection circuit;

bias circuit means coupled to the cathodes of said SCR's through interposed normally open electronic switch circuit means; and means developing a voltage in said bias circuit means due to current flow through said SCR's which is larger than a signal voltage applied to the gates of said SCR's, whereby said electronic switch circuit means are turned off by a signal from said control circuit, thereby turning off those SCR's having no signal voltage applied to their gates.

6. A world clock according to claim 5 further including an erroneous memory detection circuit connected to the biasing circuit for generating an output signal when the voltage of the biasing circuit exceeds a predetermined value, and a control circuit operable in response to said output signal to turn the electronic switch off and maintain the electronic switch in an off state until a new touch signal appears at the output terminal of the amplifier-rectifier circuit for the touch detection circuit.

7. A world clock according to claim 1, further comprising: a summer time setting circuit connected to said switching circuit; and a summer time indicator coupled to and operated by the output of the summer time setting circuit; and wherein said time difference calculation circuit further includes a further adder interposed between the adder coupled to the code converter circuit and the reference clock circuit and coupled to the switching circuit for adding the output of the switching circuit and the output of the reference clock circuit.

8. A world clock according to claim 1, further comprising a date difference indicator coupled to said date difference calculation circuit through the display drive circuit for indicating the date difference with reference to the home location as −1, 0 or +1 in response to the output of the date difference calculation circuit.

9. A world clock according to claim 3, wherein said control circuit comprises: a delay circuit coupled to said amplifier-rectifier circuit; a differentiator circuit coupled to the output of said delay circuit; means coupling the output of said differentiator circuit to said location memory circuit for clearing the contents thereof; and means coupling the output of said delay circuit to said switching circuit of said time difference generation circuit for a predetermined time period after a designated location signal has been applied to a designated touch detection terminal.

* * * * *